US007832161B2

(12) United States Patent
Ligabue

(10) Patent No.: US 7,832,161 B2
(45) Date of Patent: Nov. 16, 2010

(54) CORNER JOINT ELEMENT FOR BEVEL-EDGE TILES

(75) Inventor: Andrea Ligabue, Castelnuovo Rangone (IT)

(73) Assignee: Etruria Design S.R.L., Modena (IT)

( * ) Notice: Subject to any disclaimer, the term of this patent is extended or adjusted under 35 U.S.C. 154(b) by 64 days.

(21) Appl. No.: 12/193,061

(22) Filed: Aug. 18, 2008

(65) Prior Publication Data

US 2009/0077914 A1 Mar. 26, 2009

(30) Foreign Application Priority Data

Sep. 25, 2007 (EP) ..... 07425588

(51) Int. Cl.
*E04F 15/08* (2006.01)
*E04F 13/00* (2006.01)
*E04F 15/02* (2006.01)

(52) U.S. Cl. ..... 52/254; 52/189; 52/284; 52/311.2; D25/121; 428/157

(58) Field of Classification Search ..... 52/254, 52/182, 287.1, 179, 284, 250, 288.1, 290, 52/35, 189, 311.1, 311.2, 315, 389, 747.11, 52/255, 716.1, 384, 390, 747.12; 428/157; D25/121, 55, 136, 60, 113, 114, 118
See application file for complete search history.

(56) References Cited

U.S. PATENT DOCUMENTS 2,120,200 A * 6/1938 Clarke ..... 52/284
2,207,178 A 7/1940 Richards
D132,615 S * 6/1942 Larson ..... D25/114
3,309,832 A 3/1967 Filsinger
4,333,288 A * 6/1982 Coombs ..... 52/312
4,681,481 A 7/1987 Kapusta
4,706,427 A * 11/1987 Zeilinger ..... 52/287.1
4,829,730 A * 5/1989 Zeilinger ..... 52/287.1
5,054,957 A * 10/1991 Johnson, II ..... 404/41
5,466,089 A * 11/1995 Jurik ..... 404/34

(Continued)

FOREIGN PATENT DOCUMENTS

DE 7720324 U1 10/1977

(Continued)

OTHER PUBLICATIONS

Fournier, Thomas, European Patent Office, European Search Report for Application No. EP 07 42 5588, Feb. 2, 2008, 5 pages.

*Primary Examiner*—David Dunn
*Assistant Examiner*—Joseph J Sadlon
(74) *Attorney, Agent, or Firm*—Pearne & Gordon LLP

(57) ABSTRACT

A corner joint element for bevel-edge tiles, comprising a first in-view surface (2) and a second in-view surface (8) which are incident to one another and reciprocally inclined by a predetermined angle, in which the first in-view surface (2) exhibits a first corner (3), defined by a union of two consecutive edges (5, 6), and a second corner (4), defined by a union of two consecutive edges (6, 7). Each corner exhibits at least a tract (5*a*, 6*a*, 6*b*, 7*a*), arranged in proximity of a respective corner (3, 4) of the corners, which is downwards-inclined with respect to the first in-view surface (2) on a perpendicular plane to the first in-view surface (2).

6 Claims, 4 Drawing Sheets

U.S. PATENT DOCUMENTS

| | | | | |
|---|---|---|---|---|
| 5,494,548 | A * | 2/1996 | Baca | 156/265 |
| 6,395,116 | B1 * | 5/2002 | Mathis, Sr. | 156/71 |
| 6,438,914 | B1 * | 8/2002 | Robertson | 52/255 |
| 6,508,042 | B1 * | 1/2003 | Kweon et al. | 52/608 |
| 6,871,463 | B2 * | 3/2005 | Placuzzi | 52/390 |
| 7,018,465 | B2 * | 3/2006 | Pitts et al. | 106/415 |
| 7,118,791 | B2 * | 10/2006 | Martel | 428/40.1 |

FOREIGN PATENT DOCUMENTS

| | | | |
|---|---|---|---|
| DE | 7936344 | U1 | 3/1980 |
| DE | 3637585 | A1 * | 5/1987 |
| DE | 202004019958 | U1 | 3/2005 |
| DE | 202005017894 | U1 | 6/2006 |
| FR | 327598 | A | 12/1902 |
| FR | 493205 | A | 11/1918 |
| FR | 1120415 | A | 7/1956 |
| FR | 1539616 | A | 9/1968 |
| GB | 2025482 | A | 1/1980 |
| JP | 02304172 | A * | 12/1990 |
| RO | 110839 | B1 | 4/1996 |
| WO | WO 2005093165 | A1 * | 10/2005 |

* cited by examiner

CORNER JOINT ELEMENT FOR BEVEL-EDGE TILES

Bevel-edge tiles are special and high quality ceramic tiles exhibiting an in-view surface, i.e. the surface that will be visible after laying, which is generally-speaking convex in shape. On the in-view surface of the tile there is a slightly-inclined perimeter strip which is inclined with respect to the full surface of the tile. The in-view surface of the tile is, in substance, truncoconical with a very small angle of conicity. The effect is of a diamond's surface, as there are more than one surface. The in-view surface may be, for example, a glazed surface.

To complete coverage of a surface with ceramic tiles it is generally necessary to cut some tiles to be positioned in the marginal zones of the surface with the aim of filling the gaps left by the laying of the whole tiles. In many cases the cut tiles are positioned at the concave or convex corners and are located in contact with other tiles of other portions of tiles arranged perpendicular thereto.

From a geometrical point of view, two portions of bevel-edge tiles laid perpendicular to one another and located in reciprocal contact offer a non-uniform join edge. With particular reference to laying on a concave angle, it is easy to imagine how the terminal tracts of the edges of the two tiles, i.e. the tracts of edge which are at the inclined portion, cannot uniformly touch along the whole length, indeed, at those very terminal tracts the edges diverge. This means that laying in corners is very laborious and requires careful and precise grouting of the contact zones between the tiles positioned on the two surfaces forming the corner.

The aim of the present invention is to provide a corner joint element which enables a corner join between bevel-edge tiles to be made at a lateral edge thereof.

Further characteristics and advantages of the invention will better emerge from the detailed description that follows, made with reference to the accompanying figures of the drawings, given purely by way of non-limiting example, in which.

Figures 1, 1A:
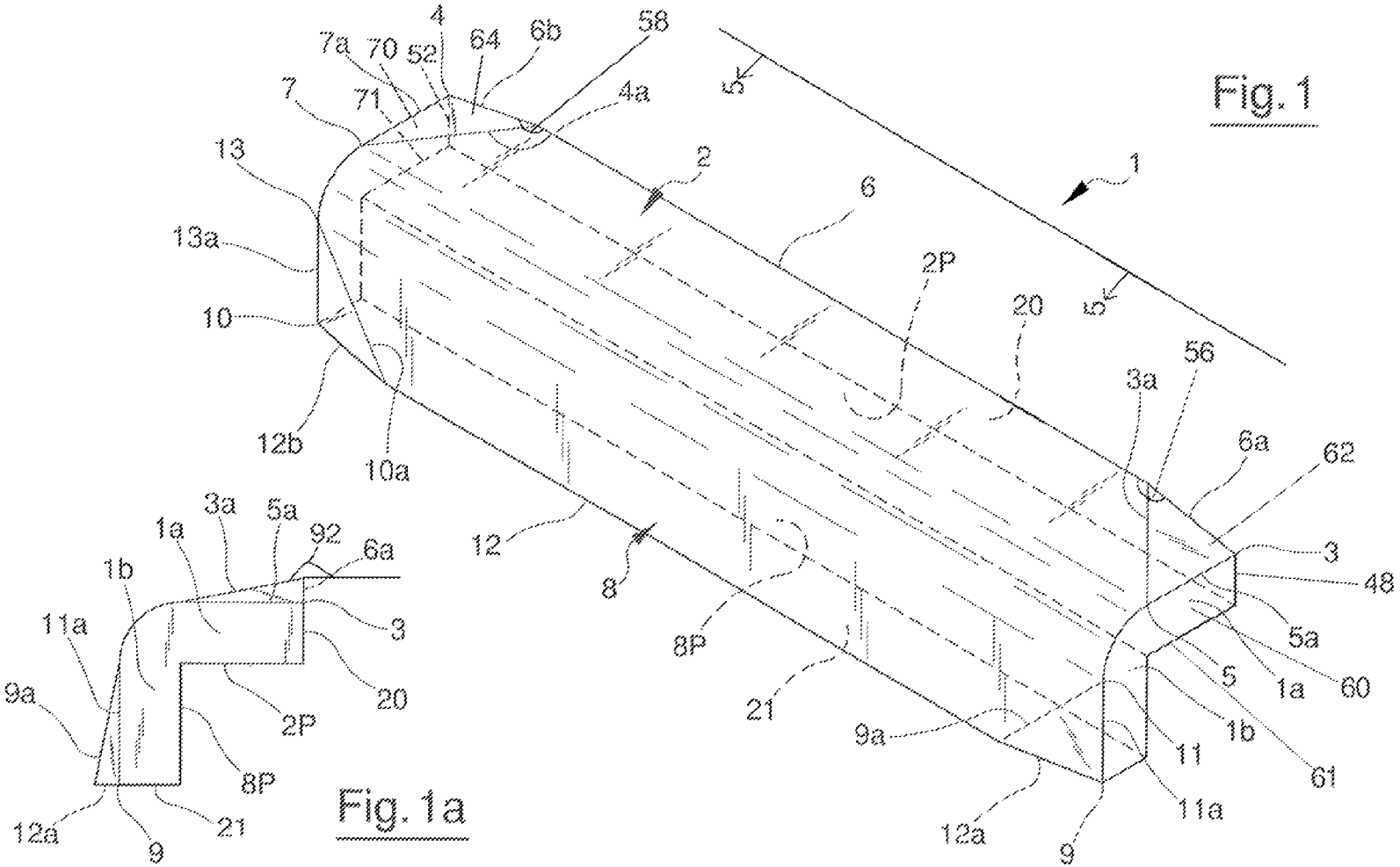
FIG. 1 is a perspective view of a first embodiment of the corner element of the present invention.
FIG. 1A is a perpendicular projection of the corner element of FIG. 1.
Figure 3:
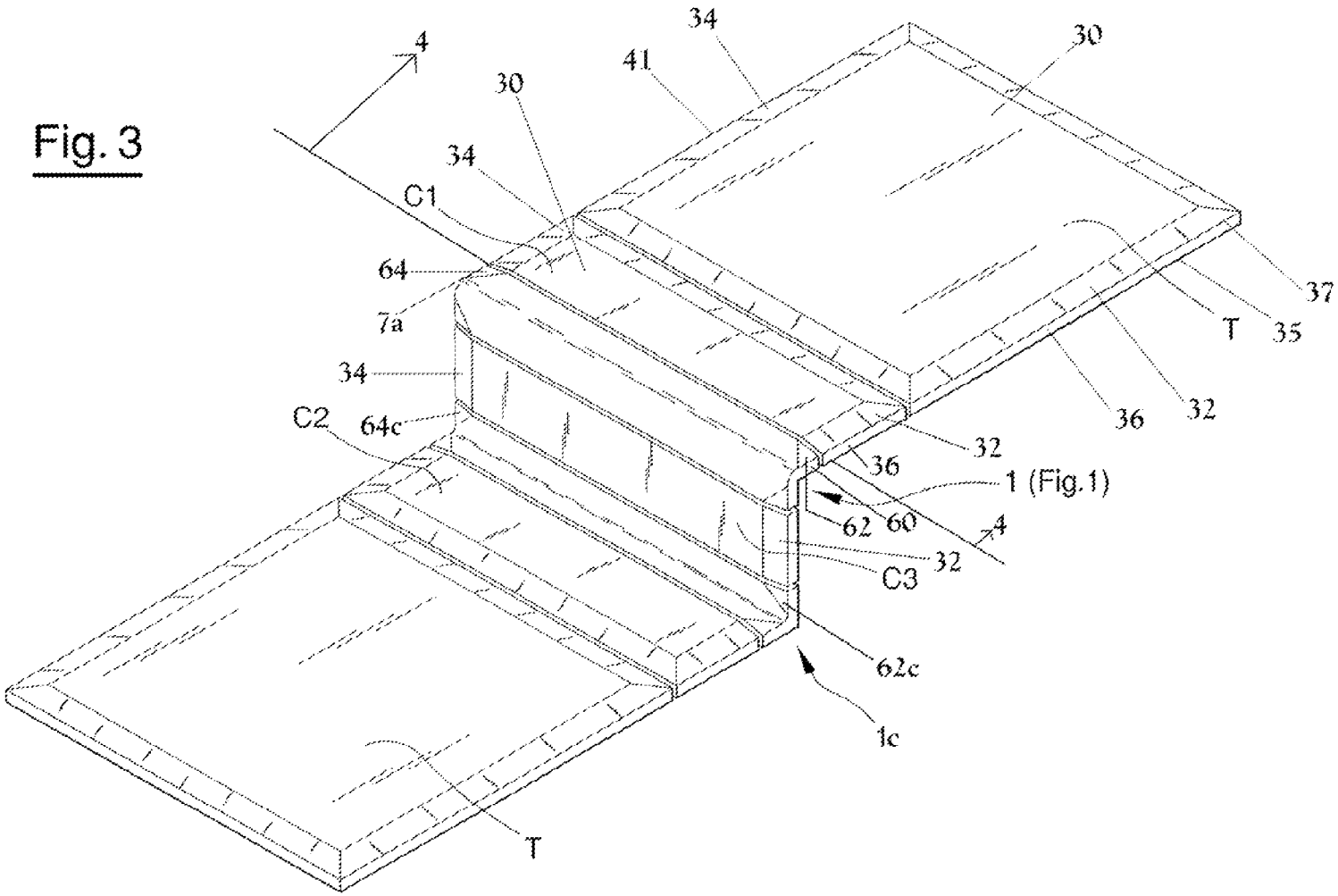
FIG. 3 is a perspective view of the two corner elements of FIGS. 1 and 2 which join bevel-edge tiles.
Figure 4:
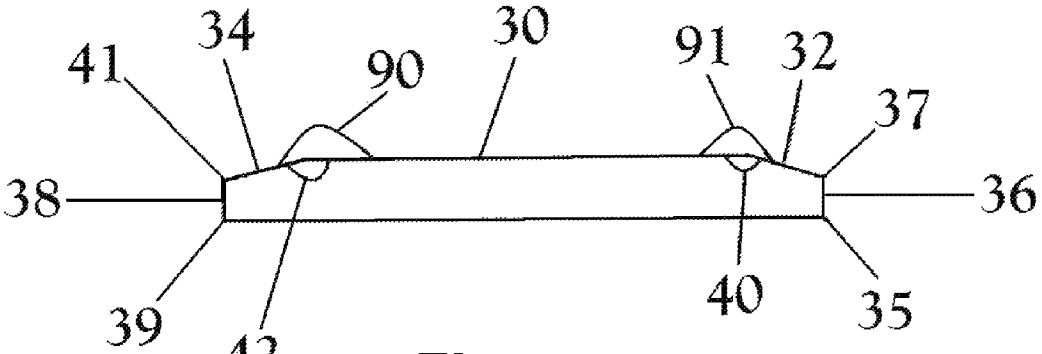
Figure 5:
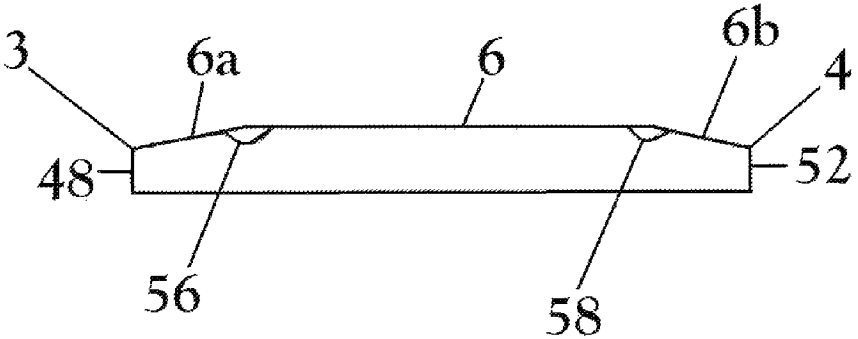

FIG. 4 is an elevational view of the cut end of a cut tile taken along line 4-4 of FIG. 3; and FIG. 5 is an elevational view of surface 20 taken along line 5-5 of FIG. 1.

DETAILED DESCRIPTION OF THE PREFERRED EMBODIMENTS OF THE INVENTION

With reference to FIGS. 1 and 3, there is shown a corner joint element 1 having a convex surface and being for use with a portion C1, C2, C3 of a tile T. The tile T has a flat top or upper surface 30, a first flat beveled edge surface 32, a second flat beveled edge surface 34, a first sidewall 36 having a top edge 37 and a bottom edge 35, and a second sidewall 38 having a top edge 41 and a bottom edge 39. When the tile is cut straight across, such as shown in C1 of FIG. 3 and in FIG. 4, the tile has a transversal section having an upper perimeter outline defined by the first sidewall 36, the first flat beveled edge surface 32, the upper surface 30, the second flat beveled edge surface 34 and the second sidewall 38. The upper perimeter outline of the transversal section of the tile is illustrated in FIG. 4; in FIG. 4 the upper perimeter outline of the transversal section is shown by the line segments labelled 38, 34, 30, 32 and 36. The corner joint element 1 includes a first in-view surface 2 extending to a top edge 6 and a second in-view surface 8 extending to a bottom edge 12. The first in-view surface 2 and the second in-view surface 8 together form a convex surface as shown in FIGS. 1 and 3. The corner joint element 1 has a first lateral surface 20 extending from the top edge 6 and a second lateral surface 21 extending from the bottom edge 12. The first lateral surface 20 is substantially perpendicular to the second lateral surface 21. The first lateral surface 20 has an upper perimeter outline defined by a first side edge 48, a first end portion 6*a*, the top edge 6, a second end portion 6*b*, and a second side edge 52, each of which is a segment of a line. The upper surface 30 and the first beveled edge surface 32 define a first obtuse angle 40. The upper surface 30 and the second beveled edge surface 34 define a second obtuse angle 42. The first obtuse angle 40 is substantially the same angle as the second obtuse angle 42. The top edge 6 and the first end portion 6*a* define a third obtuse angle 56. The top edge 6 and the second end portion 6*b* define a fourth obtuse angle 58. The third obtuse angle 56 is substantially the same angle as the fourth obtuse angle 58. The first obtuse angle 40 is substantially the same angle as the third obtuse angle 56. The first lateral surface upper perimeter outline matches the transversal section upper perimeter outline, that is, the outline of line segments 48, 6*a*, 6, 6*b* and 52 in FIG. 5 match the outline of line segments 38, 34, 30, 32 and 36 in FIG. 4. The corner joint element 1 has a first end surface 60 extending from the first side edge 48. The first end surface 60 has a top edge 5*a* and a bottom edge 61. The top edge 5*a* is a segment of a line. The bottom edge 61 and the top edge 5*a* are substantially parallel. The first end portion 6*a* and the top edge 5*a* meet at a first corner 3 and define a first plane which forms a first flat surface 62 extending from the first corner 3 and between the first end portion 6*a* and the top edge 5*a*. The corner joint element 1 has a second end surface 70 extending from the second side edge 52. The second end surface 70 has a top edge 7*a* and a bottom edge 71. The top edge 7*a* is a segment of a line. The bottom edge 71 and the top edge 7*a* are substantially parallel. The second end portion 6*b* and the top edge 7*a* meet at a second corner 4 and define a second plane which forms a second flat surface 64 extending from the second corner 4 and between the second end portion 6*b* and the top edge 7*a*. As can be seen in the Figures, when the first lateral surface 20 is placed adjacent to and substantially parallel with the transversal section of the tile with the first flat surface 62 adjacent to the first flat beveled edge surface 32 and the second flat surface 64 adjacent to the second flat beveled edge surface 34, the first flat surface 62 and the first flat beveled edge surface 32 are substantially coplanar, and the second flat surface 64 and the second flat beveled edge surface 34 are substantially coplanar. As can be seen in the Figures, the shape of the second lateral surface 21 matches the shape of the first lateral surface 20.

Figures 2, 2A:
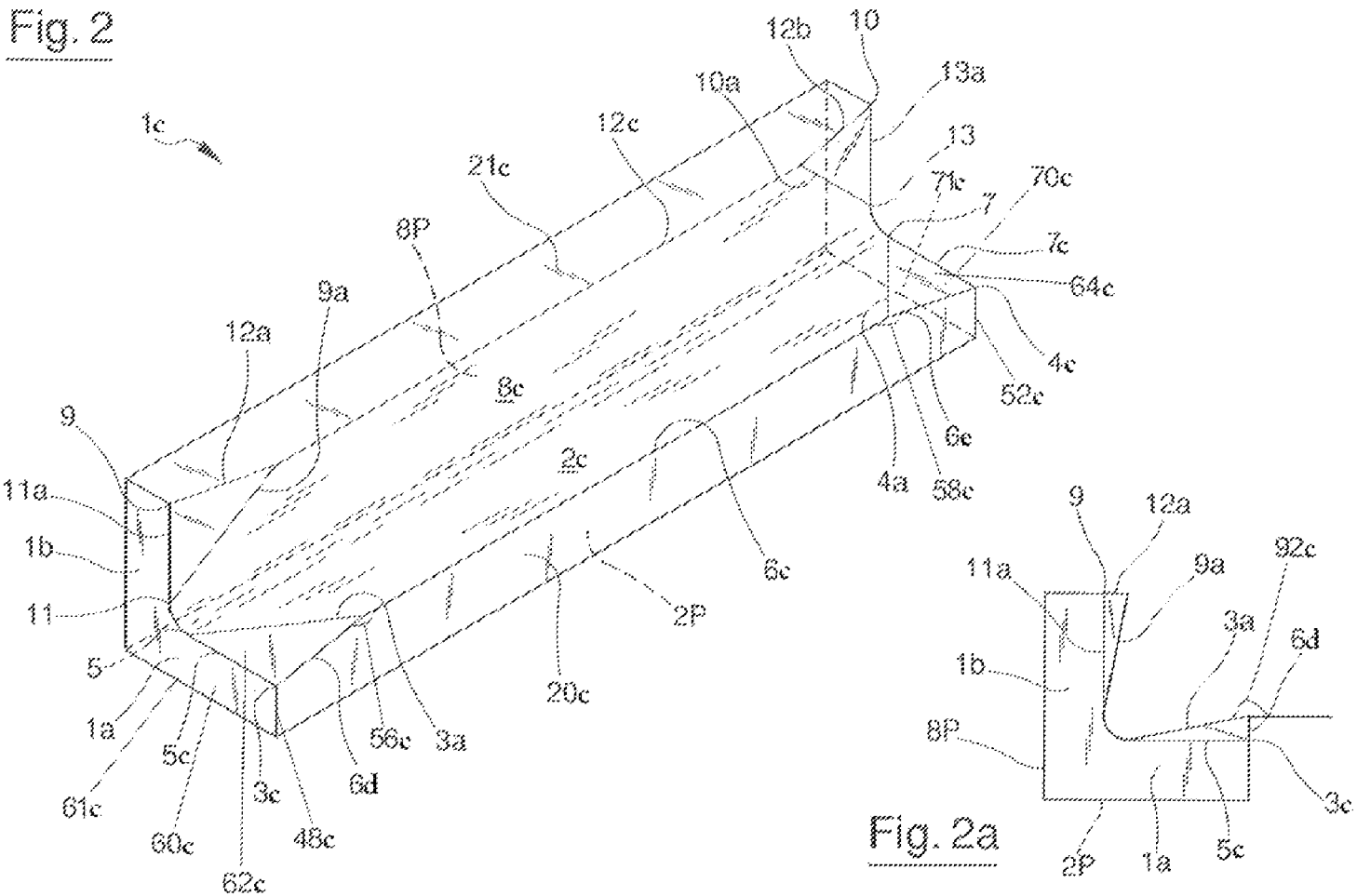
FIG. 2 is a perspective view of a second embodiment of the corner element of the present invention.
FIG. 2A is a perpendicular projection of the corner element of FIG. 2.

With reference to FIG. 2, there is shown a corner joint element 1*c* having a concave surface and being for use with a portion C1, C2, C3 of a tile T. The corner joint element 1*c* includes a first in-view surface 2*c* extending to a top edge 6*c* and a second in-view surface 8*c* extending to a bottom edge 12*c*. The first in-view surface 2*c* and the second in-view surface 8*c* together form a concave surface as shown in FIGS. 2 and 3. The corner joint element 1*c* has a first lateral surface 20*c* extending from the top edge 6*c* and a second lateral surface 21*c* extending from the bottom edge 12*c*. The first lateral surface 20*c* is substantially perpendicular to the second lateral surface 21*c*. The first lateral surface 20*c* has an upper perimeter outline defined by a first side edge 48*c*, a first end portion 6*d*, the top edge 6*c*, a second end portion 6*e*, and a second side edge 52*c*, each of which is a segment of a line. The upper surface 30 and the first beveled edge surface 32 define a first obtuse angle 40. The upper surface 30 and the second beveled edge surface 34 define a second obtuse angle 42. The first obtuse angle 40 is substantially the same angle as the second obtuse angle 42. The top edge 6*c* and the first end portion 6*d* define a third obtuse angle 56*c*. The top edge 6*c* and the second end portion 6*e* define a fourth obtuse angle 58*c*. The third obtuse angle 56*c* is substantially the same angle as the fourth obtuse angle 58*c*. The first obtuse angle 40 is substantially the same angle as the third obtuse angle 56*c*. The first lateral surface upper perimeter outline matches the transversal section upper perimeter outline, that is, the outline of line segments 48*c*, 6*d*, 6*c*, 6*e* and 52*c* in FIG. 2 match the outline of line segments 38, 34, 30, 32 and 36 in FIG. 4. The corner joint element 1*c* has a first end surface 60*c* extending from the first side edge 48*c*. The first end surface 60*c* has a top edge 5*c* and a bottom edge 61*c*. The top edge 5*c* is a segment of a line. The bottom edge 61*c* and the top edge 5*c* are substantially parallel. The first end portion 6*d* and the top edge 5*c* meet at a first corner 3*c* and define a first plane which forms a first flat surface 62*c* extending from the first corner 3*c* and between the first end portion 6*d* and the top edge 5*c*. The corner joint element 1*c* has a second end surface 70*c* extending from the second side edge 52*c*. The second end surface 70*c* has a top edge 7*c* and a bottom edge 71*c*. The top edge 7*c* is a segment of a line. The bottom edge 71*c* and the top edge 7*c* are substantially parallel. The second end portion 6*e* and the top edge 7*c* meet at a second corner 4*c* and define a second plane which forms a second flat surface 64*c* extending from the second corner 4*c* and between the second end portion 6*e* and the top edge 7*c*. As can be seen in the Figures, when the first lateral surface 20*c* is placed adjacent to and substantially parallel with the transversal section of the tile with the first flat surface 62*c* adjacent to the first flat beveled edge surface 32 and the second flat surface 64*c* adjacent to the second flat beveled edge surface 34, the first flat surface 62*c* and the first flat beveled edge surface 32 are substantially coplanar, and the second flat surface 64*c* and the second flat beveled edge surface 34 are substantially coplanar. As can be seen in the Figures, the shape of the second lateral surface 21*c* matches the shape of the first lateral surface 20*c*.

In a preferred embodiment, the corner join element of the present invention comprises a straight prismatic body 1 which, in transversal section, exhibits an L-shaped profile defined by a first portion 1*a* and a second portion 1*b*, connected to one another.

The corner element comprises a first in-view surface 2 and a second in-view surface 8, both of which will be visible after the tile is laid, which two surfaces 2, 8 are opposite respective laying surfaces 2*p*, 8*p*. The two in-view surfaces are incident to one another and inclined by a predetermined angle. In a case in which the two in-view surfaces define a convex surface, the two surfaces are inclined to one another by an obtuse angle (FIG. 1A), while in a case in which they define a concave surface, the two in-view surfaces are inclined by an acute angle (FIG. 2A). The inclination of the two in-view surfaces substantially coincides with the inclination of the perimeter strip of the bevel-edge tiles; that is, when the first lateral surface 20 is placed adjacent to and substantially parallel with the transversal section of the tile, as shown in FIG. 3, with the first flat surface 62 adjacent to the first flat beveled edge surface 32 and the second flat surface 64 adjacent to the second flat beveled edge surface 34, the angle of inclination 92, as shown in FIG. 1*a*, of the first in-view surface 2 relative to the upper surface 30 of the tile is substantially the same as the angle of inclination 91, shown in FIG. 4, of the first flat beveled edge surface 32 relative to the upper surface 30 of the tile. Similarly, when the first lateral surface 20*c* is placed adjacent to and substantially parallel with the transversal section of the tile, as shown in FIGS. 2 and 3, with the first flat surface 62*c* adjacent to the first flat beveled edge surface 32 and the second flat surface 64*c* adjacent to the second flat beveled edge surface 34, the angle of inclination 92*c*, as shown in FIG. 2*a*, of the first in-view surface 2*c* relative to the upper surface 30 of the tile is substantially the same as the angle of inclination 91, shown in FIG. 4, of the first flat beveled edge surface 32 relative to the upper surface 30 of the tile.

The first in-view surface 2 exhibits a first corner 3, defined by the union of two consecutive edges 5, 6, and a second corner 4, defined by the union of two consecutive edges 6, 7. Each exhibits at least a tract 5*a*, 6*a*, 6*b*, 7*a*, arranged in proximity of the respective corner 3, 4, which is downwards-inclined with respect to the first in-view surface 2 on a perpendicular plane to the first in-view surface 2.

As can be seen in the accompanying figures of the drawings, the first corner 3 is defined by the union between a first edge 5 and a second edge 6 of the first in-view surface 2. In particular, the first corner is defined by the union between an end portion 5*a* of the first edge 5 and a first end portion 6*a* of the second edge 6. The two end portions 5*a* and 6*a* are inclined in a distancing direction from the first in-view surface 2, such that the first corner 3 is in a retracted position with respect to the in-view surface 2. In other words, the first in-view surface comprises a portion of corner, on which a first corner 3 lies, which is inclined downwardly with respect to the first in-view surface 2 about an edge 3*a* which intersects the first and the second edge 5, 6, delimiting a right-angled triangle with the portions of end 5*a*, 6*a*. The prismatic body 1 is thus bevelled, at a portion of the first in-view surface 2 on which the first corner 3 lies, with an inclined plane with respect to the first and the second edges 5, 6.

Similarly to the first corner 3, the second corner 4 is defined by the union between the second edge 6 and a third edge 7 of the first in-view surface 2. In particular the second corner 4 is defined by the union between a second end portion 6*b* of the second edge 6 and an end portion 7*a* of the third edge 7. The two end portions 7*a* and 6*b* are inclined as they distance from the first in-view surface 2, so that the second corner 4 is in a retracted position with respect to the in-view surface 2. In other terms, the first in-view surface 2 comprises a second portion of corner, on which the second corner 4 lies, which is inclined downwardly with respect to the first in-view surface 2 about an edge 4*a* which intersects the second and the third edge 6, 7, delimiting a right-angled triangle with the end portions 6*b*, 7*a*. The prismatic body 1 is therefore bevelled, also at a portion of the first in-view surface 2 on which the second corner lies 4, with a plane that is inclined with respect to the second and the third edge 6, 7.

The structured corner element, as described above, exhibits a first lateral surface 20, at an angle to the first in-view surface 2, an outline of which precisely imitates an outline of a transversal section of a bevel-edge tile. In this way, when the bevel-edge tile is brought side-by-side to the first lateral surface 20, a continuous join is formed, without any empty spaces.

Entirely similarly to the first in-view surface 2, the second in-view surface 8 exhibits a first corner 9, defined by the union of a first and a second edge 11, 12, and a second corner 10, defined by the union of the second edge 12 with a third edge 13.

Each edge exhibits at least a tract 11*a*, 12*a*, 12*b*, 13*a*, arranged in proximity of a respective corner 9, 10, which is inclined backwards with respect to the second in-view surface 8 on a perpendicular plane to the second in-view surface 8. All the description and the considerations made with reference to the first in-view surface 2 can be reproduced identically with respect to the second in-view surface 8, obviously with reference to the elements of the second surface in place of the elements of the first surface 2. In particular, the second in-view surface 8 comprises a first and a second portion of corner, on which the first corner 9 and the second corner 10 respectively lie, which are inclined backwards with respect to the second in-view surface 8 about respective edges 9*a*, 10*a* which intersect the first and the second edges 11, 12 and the second and third edge 12, 13 delimiting two right-angled triangles with the portions of end 11*a*, 12*a*, 12*b*, 13*a*. The prismatic body 1 is therefore bevelled, including at the two portions of the second in-view surface 8 on which the first and the second corner 10, 11 lie, with two inclined planes with respect to the edges.

The corner element exhibits a second lateral surface 21, at an angle to the second in-view surface 8, the edge of which precisely imitates the edge of a lateral surface of a bevel-edge tile. In this way, when the bevel-edge tile is neared to the corner element at the second lateral surface 21, a continuous join, free of empty parts, is achieved.

As can be seen in the figures of the drawings, the in-view surfaces 2, 8 can be arranged on the external side of the right-angled prismatic side 1, such as to define overall a convex surface (FIG. 1), or they can be arranged on the internal side of the straight prismatic body, such as to define overall a concave surface; this can be seen in FIG. 2. In the first case (FIG. 1) the corner element enables a surface having a convex angle to be covered continuously, while in the second case (FIG. 2) a surface provided with a concave angle can be continuously covered. In both cases, the join zone between the first in-view surface 2, 2*c* and the second in-view surface 8, 8*c* is preferably rounded. FIG. 3 depicts both cases of a convex angle and of a concave angle covered by means of the corner elements according to the present invention.

In FIG. 3 the function of the corner element is clearly disclosed. In order to cover a surface having a convex or concave angle, a gap is left between an entire bevel-edge tile T and a corner element 1 or 1*c*. The gap is filled by means of a cut piece c1, c2 of a bevel-edge tile T. The cut side of the cut pieces c1, c2 perfectly match (a) the first and second lateral surfaces 20, 21 of the corner element 1 and (b) the first and second lateral surfaces 20*c*, 21*c* of the corner element 1*c*.

The corner elements of the present invention enables corner joins to be achieved between bevel-edge tiles simply, rapidly and with very pleasing results. The join edges between the tiles and the corner element are precise and uniform, and enable the grouting operations of the lines between the tiles to be simplified.

The invention claimed is:

1. A corner joint element and a bevel-edge tile, the corner joint element (1) having a convex surface and being for use with a portion of said tile, said tile having a flat top or upper surface (30), a first flat beveled edge surface (32), a second flat beveled edge surface (34), a first sidewall (36) having a top edge (37) and a bottom edge (35), and a second sidewall (38) having a top edge (41) and a bottom edge (39), the tile having a transversal section having an upper perimeter outline defined by the first sidewall (36), the first flat beveled edge surface (32), the upper surface (30), the second flat beveled edge surface (34), and the second sidewall (38), the corner joint element (1) comprising a first in-view surface (2) extending to a top edge (6) and a second in-view surface (8) extending to a bottom edge (12), the first in-view surface (2) and the second in-view surface (8) together forming a convex surface, the corner joint element (1) having a first lateral surface (20) extending from the top edge (6) and a second lateral surface (21) extending from the bottom edge (12), the first lateral surface (20) being substantially perpendicular to the second lateral surface (21), the first lateral surface (20) having an upper perimeter outline defined by a first side edge (48), a first end portion (6*a*), the top edge (6), a second end portion (6*b*), and a second side edge (52), each of which is a segment of a line, the upper surface (30) and the first beveled edge surface (32) defining a first obtuse angle (40), the upper surface (30) and the second beveled edge surface (34) defining a second obtuse angle (42), the first obtuse angle (40) being substantially the same angle as the second obtuse angle (42), the top edge (6) and the first end portion (6*a*) defining a third obtuse angle (56), the top edge (6) and the second end portion (6*b*) defining a fourth obtuse angle (58), the third obtuse angle (56) being substantially the same angle as the fourth obtuse angle (58), the first obtuse angle (40) being substantially the same angle as the third obtuse angle (56), the first lateral surface upper perimeter outline matching the transversal section upper perimeter outline, the corner joint element (1) having a first end surface (60) extending from the first side edge (48), the first end surface (60) having a top edge (5*a*) and a bottom edge (61), the top edge (5*a*) being a segment of a line, the bottom edge (61) and the top edge (5*a*) being substantially parallel, the first end portion (6*a*) and the top edge (5*a*) meeting at a first corner (3) and defining a first plane which forms a first flat surface (62) extending from the first corner (3) and between the first end portion (6*a*) and the top edge (5*a*), the corner joint element (1) having a second end surface (70) extending from the second side edge (52), the second end surface (70) having a top edge (7*a*) and a bottom edge (71), the top edge (7*a*) being a segment of a line, the bottom edge (71) and the top edge (7*a*) being substantially parallel, the second end portion (6*b*) and the top edge (7*a*) meeting at a second corner (4) and defining a second plane which forms a second flat surface (64) extending from the second corner (4) and between the second end portion (6*b*) and the top edge (7*a*), such that when the first lateral surface (20) is placed adjacent to and substantially parallel with the transversal section of the tile with the first flat surface (62) adjacent to the first flat beveled edge surface (32) and the second flat surface (64) adjacent to the second flat beveled edge surface (34), the first flat surface (62) and the first flat beveled edge surface (32) are substantially coplanar, and the second flat surface (64) and the second flat beveled edge surface (34) are substantially coplanar, and wherein the shape of the second lateral surface (21) matches the shape of the first lateral surface (20).

2. The corner joint element and bevel-edge tile of claim 1, wherein, when the first lateral surface (20) is placed adjacent to and substantially parallel with the transversal section of the tile with the first flat surface (62) adjacent to the first flat beveled edge surface (32) and the second flat surface (64) adjacent to the second flat beveled edge surface (34), the angle of inclination (92) of the first in-view surface (2) relative to the upper surface (30) of the tile is substantially the same as the angle of inclination (91) of the first flat beveled edge surface (32) relative to the upper surface (30) of the tile.

3. The corner joint element and bevel-edge tile of claim 1, wherein the first in-view surface (2) and the second in-view surface (8) are glazed surfaces.

4. A corner joint element and a bevel-edge tile, the corner joint element (1*c*) having a concave surface and being for use with a portion of said tile, said tile having a flat top or upper surface (30), a first flat beveled edge surface (32), a second flat beveled edge surface (34), a first sidewall (36) having a top edge (37) and a bottom edge (35), and a second sidewall (38) having a top edge (41) and a bottom edge (39), the tile having a transversal section having an upper perimeter outline defined by the first sidewall (36), the first flat beveled edge surface (32), the upper surface (30), the second flat beveled edge surface (34), and the second sidewall (38), the corner joint element (1*c*) comprising a first in-view surface (2*c*) extending to a top edge (6*c*) and a second in-view surface (8*c*) extending to a bottom edge (12*c*), the first in-view surface (2*c*) and the second in-view surface (8*c*) together forming a concave surface, the corner joint element (1*c*) having a first lateral surface (20*c*) extending from the top edge (6*c*) and a second lateral surface (21*c*) extending from the bottom edge (12*c*), the first lateral surface (20*c*) being substantially perpendicular to the second lateral surface (21*c*), the first lateral surface (20*c*) having an upper perimeter outline defined by a first side edge (48*c*), a first end portion (6*d*), the top edge (6*c*), a second end portion (6*e*), and a second side edge (52*c*), each of which is a segment of a line, the upper surface (30) and the first beveled edge surface (32) defining a first obtuse angle (40), the upper surface (30) and the second beveled edge surface (34) defining a second obtuse angle (42), the first obtuse angle (40) being substantially the same angle as the second obtuse angle (42), the top edge (6*c*) and the first end portion (6*d*) defining a third obtuse angle (56*c*), the top edge (6*c*) and the second end portion (6*e*) defining a fourth obtuse angle (58*c*), the third obtuse angle (56*c*) being substantially the same angle as the fourth obtuse angle (58*c*), the first obtuse angle (40) being substantially the same angle as the third obtuse angle (56*c*), the first lateral surface upper perimeter outline matching the transversal section upper perimeter outline, the corner joint element (1*c*) having a first end surface (60*c*) extending from the first side edge (48*c*), the first end surface (60*c*) having a top edge (5*c*) and a bottom edge (61*c*), the top edge (5*c*) being a segment of a line, the bottom edge (61*c*) and the top edge (5*c*) being substantially parallel, the first end portion (6*d*) and the top edge (5*c*) meeting at a first corner (3*c*) and defining a first plane which forms a first flat surface (62*c*) extending from the first corner (3*c*) and between the first end portion (6*d*) and the top edge (5*c*), the corner joint element (1*c*) having a second end surface (70*c*) extending from the second side edge (52*c*), the second end surface (70*c*) having a top edge (7*c*) and a bottom edge (71*c*), the top edge (7*c*) being a segment of a line, the bottom edge (71*c*) and the top edge (7*c*) being substantially parallel, the second end portion (6*e*) and the top edge (7*c*) meeting at a second corner (4*c*) and defining a second plane which forms a second flat surface (64*c*) extending from the second corner (4*c*) and between the second end portion (6*e*) and the top edge (7*c*), such that when the first lateral surface (20*c*) is placed adjacent to and substantially parallel with the transversal section of the tile with the first flat surface (62*c*) adjacent to the first flat beveled edge surface (32) and the second flat surface (64*c*) adjacent to the second flat beveled edge surface (34), the first flat surface (62*c*) and the first flat beveled edge surface (32) are substantially coplanar, and the second flat surface (64*c*) and the second flat beveled edge surface (34) are substantially coplanar, and wherein the shape of the second lateral surface (21*c*) matches the shape of the first lateral surface (20*c*).

5. The corner joint element and bevel-edge tile of claim 4, wherein, when the first lateral surface (20*c*) is placed adjacent to and substantially parallel with the transversal section of the tile with the first flat surface (62*c*) adjacent to the first flat beveled edge surface (32) and the second flat surface (64*c*) adjacent to the second flat beveled edge surface (34), the angle of inclination (92*c*) of the first in-view surface (2*c*) relative to the upper surface (30) of the tile is substantially the same as the angle of inclination (91) of the first flat beveled edge surface (32) relative to the upper surface (30) of the tile.

6. The corner joint element and bevel-edge tile of claim 4, wherein the first in-view surface (2*c*) and the second in-view surface (8*c*) are glazed surfaces.

* * * * *